US008004199B2

(12) United States Patent
Beij et al.

(10) Patent No.: US 8,004,199 B2
(45) Date of Patent: Aug. 23, 2011

(54) METHOD FOR POWERING A CONTROL CIRCUIT FOR A GAS DISCHARGE LAMP DURING PRE-HEATING OF SAID LAMP, AND A DEVICE FOR PERFORMING SAID METHOD

(75) Inventors: Marcel Beij, Eindhoven (NL); Theodoor Hubert Stommen, Eindhoven (NL); Bertrand Johan Edward Hontele, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 380 days.

(21) Appl. No.: 12/375,055

(22) PCT Filed: Jul. 13, 2007

(86) PCT No.: PCT/IB2007/052810
§ 371 (c)(1),
(2), (4) Date: Jan. 26, 2009

(87) PCT Pub. No.: WO2008/015602
PCT Pub. Date: Feb. 7, 2008

(65) Prior Publication Data

US 2009/0309507 A1 Dec. 17, 2009

(30) Foreign Application Priority Data

Jul. 31, 2006 (EP) ..... 06118208

(51) Int. Cl.
*H05B 39/00* (2006.01)
*H05B 41/14* (2006.01)

(52) U.S. Cl. ..... 315/94; 315/101; 315/106; 315/107

(58) Field of Classification Search ..... None
See application file for complete search history.

(56) References Cited

U.S. PATENT DOCUMENTS

| | | | | |
|---|---|---|---|---|
| 5,422,545 | A * | 6/1995 | Felper et al. | 315/209 R |
| 5,444,333 | A | 8/1995 | Lau | |
| 6,153,983 | A * | 11/2000 | Nerone et al. | 315/289 |
| 6,169,369 | B1 | 1/2001 | Nerone et al. | |
| 6,211,620 | B1 | 4/2001 | Gyoten et al. | |
| 2006/0055339 | A1 | 3/2006 | Rudolph | |

FOREIGN PATENT DOCUMENTS

WO 9810623 A1 3/1998

OTHER PUBLICATIONS

Data Sheet UBA2000T Electronic TL-lamp Starter, Philips Semiconductors, Jan. 3, 1996, pp. 1-16.

* cited by examiner

*Primary Examiner* — Anh Q Tran

(57) ABSTRACT

The method according to the present invention relates to controlling a gas discharge lamp during a pre-heating period of said lamp, wherein a first terminal of a control circuit is connected with a first electrode of the lamp and a second terminal of a control circuit is connected with a second electrode of the lamp, and wherein means are provided, suitable for connecting the first terminal and the second terminal with each other, thus providing a conducting path, and suitable for disconnecting the first terminal and the second terminal. Furthermore the method comprises the use of a chargeable and dischargeable power buffer, for powering control circuitry for operating the switching means.

13 Claims, 1 Drawing Sheet

METHOD FOR POWERING A CONTROL CIRCUIT FOR A GAS DISCHARGE LAMP DURING PRE-HEATING OF SAID LAMP, AND A DEVICE FOR PERFORMING SAID METHOD

FIELD OF THE INVENTION

The invention relates to a method and device for controlling a gas discharge lamp during a pre-heating period of said lamp.

BACKGROUND OF THE INVENTION

Pre-heating the electrodes prior to ignition of a gas discharge lamp is performed for preventing excessive deterioration of said electrodes. A known method for pre-heating electrodes is switching a current through the electrodes which may be series connected for that purpose. This switching may be done under control of an electrical circuit. Devices for controlling a gas discharge lamp are often referred to as a "starter" in the art. In fact, starters comprising electrical circuit, comprising e.g. a microcontroller, may also be applied for controlling the lamp after the starting phase, for controlling voltages, currents, frequencies and waveforms of the lamp. These electrical circuits may require a low DC voltage power supply, e.g. of 5 to 24 Volts, which may be retrieved from a mains voltage, or—for reasons of availability of a limited number of terminals in a standard lamp housing, from a lamp voltage. For that purpose, the control circuit may be connected in series with the lamp electrodes during starting of the lamp. In such configuration, for enabling a pre-heating current to flow through the lamp electrodes, it may be necessary to shortcircuit the terminals of the control circuit. A power source is then needed to power at least the electrical circuit during the pre-heating period.

When considering the use of a charged capacitor as a power source, a capacitor that can store enough power for an average intelligent building block to bridge an average pre-heating period appears to require such large physical dimensions that it cannot be integrated in a commonly applied control circuit housing. Also attempts to reduce the power absorbed by an intelligent building block by switching at least a microcontroller thereof to very low energy consumption or by switching off peripherals have not lead to a working solution.

OBJECT OF THE INVENTION

It is an object of the present invention to provide a method and device for controlling a gas discharge lamp during pre-heating of said lamp, without requiring the use of components that cannot be integrated in a common control circuit housing.

SUMMARY OF THE INVENTION

The present invention fulfils the above-mentioned objects with a device according to claim 1, and a method according to claim 9.

The method according to the present invention relates to controlling a gas discharge lamp during a pre-heating period of said lamp, wherein a first terminal of a control circuit, comprising a chargeable and dischargeable power buffer, is connected with a first electrode of the lamp and a second terminal of a control circuit is connected with a second electrode of the lamp, and wherein connecting means are provided, suitable for connecting the first terminal and the second terminal with each other, thus providing a conducting path, and suitable for disconnecting the first terminal and the second terminal. Furthermore the method comprises the use of a chargeable and dischargeable power buffer for powering at least part of a control circuit. In at least a first interval during the pre-heating period of the lamp, the connecting means do not connect the first terminal to the second terminal. Instead, the power buffer is coupled to the first terminal and the second terminal for enabling charging of said buffer. In a second interval during a pre-heating period of the lamp the connecting means are operated to connect the first terminal and the second terminal for enabling flow of a current for pre-heating the first lamp electrode and the second lamp electrode.

The method according to the present invention may further comprise the step of discharging the power buffer during the second interval during a pre-heating period of the lamp, e.g. for powering at least part of a control circuit controlling the gas discharge lamp.

The method according to the present invention may further comprise intermittently providing the conducting path and charging the power buffer during the pre-heating period of the lamp, when said pre-heating period of the lamp exceeds the time it takes for the control circuit to unload the buffer to avoid the power buffer to become empty.

During charging of the buffer, pre-heating of the lamp is interrupted. For that reason it may be advantageous to keep the first interval short, e.g. about a few milliseconds, and preferably shorter than the second interval, to prevent an excessive cooling down of the lamp electrodes during the first interval.

The invention will be explained into more detail with reference to the accompanying figures.

DETAILED DESCRIPTION OF EXAMPLES

Figure 1:
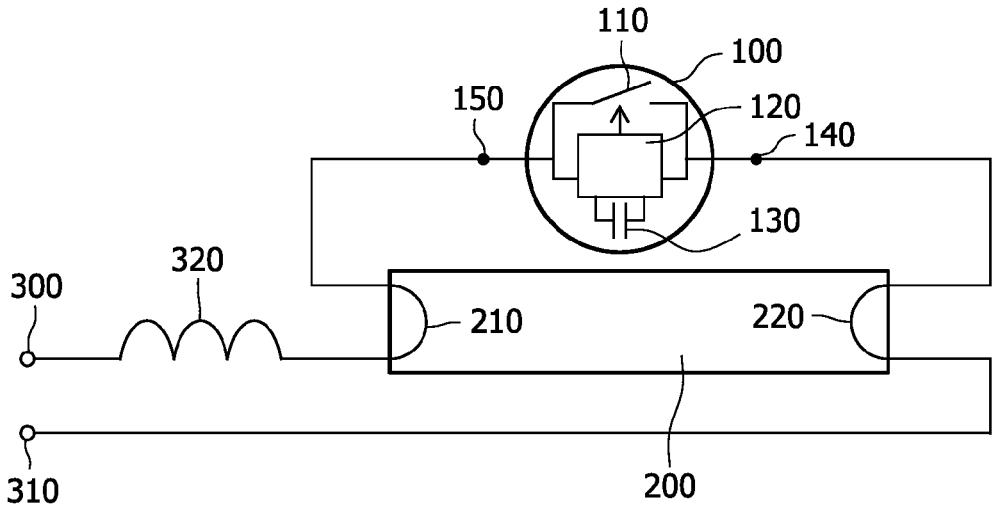
FIG. 1 shows a schematic diagram of an embodiment of a device for performing the method according to the present invention.

FIG. 1 shows an embodiment of a device 100 for performing the method according to the present invention. The device comprises a control circuit 100 for starting a lamp 200. The lamp 200 is coupled with a first electrode 210 to a first mains terminal 300 via an inductor 320, and it is coupled with a second electrode 220 to a second mains terminal 310.

The control circuit 100 comprises a controllable switch 110, an electronic circuit 120, and a power buffer, formed by a capacitor 130. The controllable switch 110 is operated by electronic circuit 120, which may further comprise intelligent building blocks for operating the lamp 200. In an open (i.e. non-conducting) position of controllable switch 110 the electronic circuit 120 is connected in series with the lamp 200 and the inductor 320, and thereby coupled to a mains voltage, applied across the first mains terminal 300 and the second mains terminal 310. In a closed (i.e. conducting) status of the switch 110, the lamp 200 is coupled in series with the inductor 320 a the mains voltage applied across the first mains terminal 300 and the second mains terminal 310, allowing a pre-heating current to flow through the lamp 200. In the closed (i.e. conducting) position of controllable switch 110 the electronic circuit 120 is short-circuited, and therefor not coupled to the mains voltage. A capacitor 130 is also coupled to electronic circuit 120 for powering the electronic circuit 120 when it is not coupled to the mains voltage.

Figure 2:
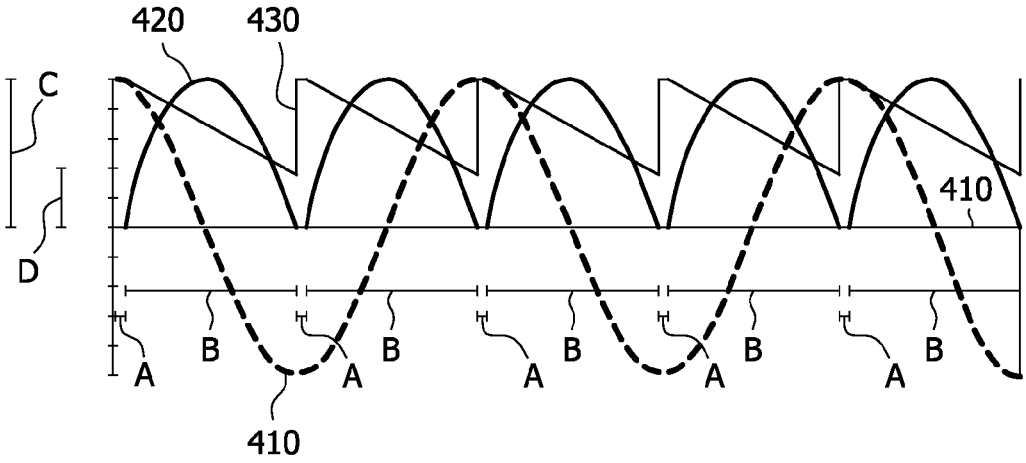
FIG. 2 shows waveforms of currents and voltages in the device in FIG. 1.

The operation of the control circuit 100 will be explained below with reference to the graph 400 shown in the FIG. 2. Graph 400 shows a timeline 401, against which a mains voltage 410 is drawn. Mains voltage 410 may be a 230 Volts 50 Hz Voltage. During time intervals A, the controllable switch 110 is switched in an open (i.e. non-conducting) position by the electrical circuit 120. The beginning of an interval A is preferably selected such that there is essentially no current flowing through the inductance 320 and the lamp 200. Therefore, no voltage is induced across the inductance 320, preventing an undesired ignition of the lamp 200. Furthermore, due to inductance 320, a moment of momentary low current through the inductance 320 coincides with a high momentary value of the mains voltage, which is advantageous for charging the capacitor 130. Due to the relatively high resistance of the control circuit 100 with respect to the lamp 200 and the inductor 320, essentially the entire mains voltage is present across a first terminal 140 and the second terminal 150 of control circuit 100, and a very low current flows through the lamp 200. During the time intervals A, the capacitor 130 is coupled to the mains voltage for charging.

During time intervals B, the switch 110 is switched in a closed (i.e. conducting) position by electrical circuit 120. Electrical circuit 120 is then short-circuited, and it is powered by the charged capacitor 130. The voltage 430 across the capacitor therefore decreases during the intervals B, from a high value C to a low value D, while the lamp electrode 210 and lamp electrode 220 are pre-heated by lamp current 420.

The pre-heating period of the lamp may take a plurality of intervals A and intervals B. In a practical application of the present invention, wherein a pre-heating time of a lamp requires e.g. 1500 milliseconds, and wherein the electronic circuit 120 of control circuit 100 may require a powering current of 2 mA, a permitted voltage drop of 200 Volts from the high voltage value C to the low voltage value D may require a capacitor of 15 μF, at 350 Volts, which is too large to fit in a common control circuit housing. A value of capacitor 130 of 1 μF however, would be applicable for use in a common control circuit housing. Such capacitor is, however, only able to power the electrical circuit for about 100 milliseconds. By dividing the pre-heating period into e.g. 15 pairs of intervals A and intervals B, each pair of intervals A and B have a common length of 100 milliseconds, corresponding to 10 half periods of a 50 Hz mains voltage. The first interval A may be selected to comprise 10 milliseconds, i.e. a half period of the mains voltage, and the second interval B may be selected to comprise 90 milliseconds, i.e. nine half periods of the mains voltage.

As a result, one tenth of the pre-heating time of the lamp 200 the lamp current 420 equals zero. This may lead to a requirement of an essentially one tenth longer pre-heating period. By selecting a ratio of a length of the first interval A and the second interval B, the required pre-heating time may be adapted to any applicable specification.

The schematic circuit shown in FIG. 1 can be realized in many ways, with use of electrical components that are known as such. Switch 110 may be a transistor, e.g. a FET. Electronic circuit 120 may comprise known intelligent building blocks for controlling a lamp after the pre-heating period of said lamp, the building blocks e.g. being configured for modulating the lamp voltage, e.g. by pulse width modulation. Furthermore, the control circuit 100 may comprise means for receiving control signals, e.g. control signals for switching the lamp on and off, or for controlling it's light brightness or intensity.

As required, a detailed embodiment of the present invention is disclosed herein, and it is to be understood that the disclosed embodiment is merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Further, the terms and phrases used herein are not intended to be limiting; but rather, to provide an understandable description of the invention. The terms "a" or "an", as used herein, are defined as one or more than one. The term another, as used herein, is defined as at least a second or more. The terms including and/or having, as used herein, are defined as comprising (i.e., open language). The term coupled, as used herein, is defined as connected, although not necessarily directly, and not necessarily by means of wires.

The invention claimed is:

1. Control circuit for a gas discharge lamp circuit, comprising:

a first terminal configured to be connected to a first electrode of a gas discharge lamp;

a second terminal configured to be connected to a second electrode of a gas discharge lamp;

a controllable switch, comprising a closed status providing a conductive path between the first and second terminal, and an open status interrupting the conductive path between the first and second terminal;

an electronic circuit, coupled to the first terminal and the second terminal, for operating the switch;

a chargeable and dischargeable power buffer, coupled to the electronic circuit, for powering the electronic circuit;

wherein:

the electronic circuit is configured to intermittently operate the switch during a pre-heating period of the gas discharge lamp between:

the open status for enabling the power buffer to be charged by a voltage applied across the first terminal and the second terminal;

the closed status for enabling a pre-heating current to flow through at least an electrode of the lamp.

2. Control circuit according to claim 1, wherein the power buffer is discharged by powering the electronic circuit when the switch is switched to a closed status.

3. Control circuit according to claim 1, wherein the controllable switch comprises a transistor.

4. Control circuit according to claim 1, wherein the power buffer comprises a capacitor.

5. Control circuit according to claim 1, wherein the electronic circuit comprises a microcontroller.

6. Control circuit according to claim 5, wherein the microcontroller is at least configured to control the lamp after the pre-heating period.

7. Control circuit according to claim 1, further comprising an inductance, configured to be coupled in series with the lamp.

8. Control circuit according to claim 1, wherein the switch is switched to the open status when a current through the lamp is about zero.

9. Gas discharge lamp, provided with a control circuit according to claim 1.

10. Method for controlling a gas discharge lamp during a pre-heating period of said lamp, comprising:

powering an electronic circuit for controlling the lamp by a power buffer;

charging the power buffer while interrupting the pre-heating of the lamp; and preheating the lamp while interrupting the charging of the powerbuffer.

11. Method according to claim 10 wherein the powering the buffer is performed in a first time interval, which is essentially shorter than a second interval in which the buffer is preheated.

12. Method according to claim 11, wherein the first interval is between one fifth to one fiftieth of the second interval.

13. Method according to claim 10, comprising intermittently repeating:

charging the power buffer while interrupting the pre-heating of the lamp; and preheating the lamp while interrupting the charging of the powerbuffer;

during a pre-heating period of the lamp.

* * * * *